US006309334B1

(12) United States Patent
Planas Xapelli

(10) Patent No.: US 6,309,334 B1
(45) Date of Patent: Oct. 30, 2001

(54) DIVIDER FOR CARDBOARD BOXES

(75) Inventor: Maria Josefa Planas Xapelli, Barcelona (ES)

(73) Assignee: Videcart, S.A., Navarra (ES)

( * ) Notice: Subject to any disclaimer, the term of this patent is extended or adjusted under 35 U.S.C. 154(b) by 0 days.

(21) Appl. No.: 09/242,080

(22) PCT Filed: Aug. 6, 1997

(86) PCT No.: PCT/ES97/00207

§ 371 Date: Apr. 8, 1999

§ 102(e) Date: Apr. 8, 1999

(87) PCT Pub. No.: WO98/06632

PCT Pub. Date: Feb. 19, 1998

(30) Foreign Application Priority Data

Aug. 9, 1996 (ES) ..... 9601786

(51) Int. Cl.[7] ..... B31B 11/00
(52) U.S. Cl. ..... 493/90; 493/91; 493/150
(58) Field of Search ..... 493/90, 91, 93, 493/84, 150, 131, 344, 374

(56) References Cited

U.S. PATENT DOCUMENTS 4,151,788 * 5/1979 Wiseman .
5,601,521 2/1997 Plamas Xapelli ..... 493/346
5,626,284 * 5/1997 Franzen ..... 493/90

FOREIGN PATENT DOCUMENTS 1931611 2/1970 (DE) .
911027 11/1962 (GB) .
1279281 6/1972 (GB) ..... B65D/25/04

* cited by examiner

*Primary Examiner*—Eugene Kim
(74) *Attorney, Agent, or Firm*—Steinberg & Raskin, P.C.

(57) ABSTRACT

It comprises a plurality of flat strips (1) and a plurality of dividing walls (2) arranged transversally to the flat strips (1), the length of each flat strip (1) being substantially equal to one of the dimensions of the box (4), and each dividing wall (2) being set between two adjacent flat strips (1) or between one flat strip (1) and a wall of the box (4), and at least some of the dividing walls (2) having a flap **(3, 3*a*) at each end, and each of the flaps (3, 3*a*) being glued to a flat strip (1) or to the wall of the box (4)**. The divider can be manufactured in a totally automated continuous process, and allows a remarkable saving of materials while its strength is not reduced.

10 Claims, 3 Drawing Sheets

FIG. 4a
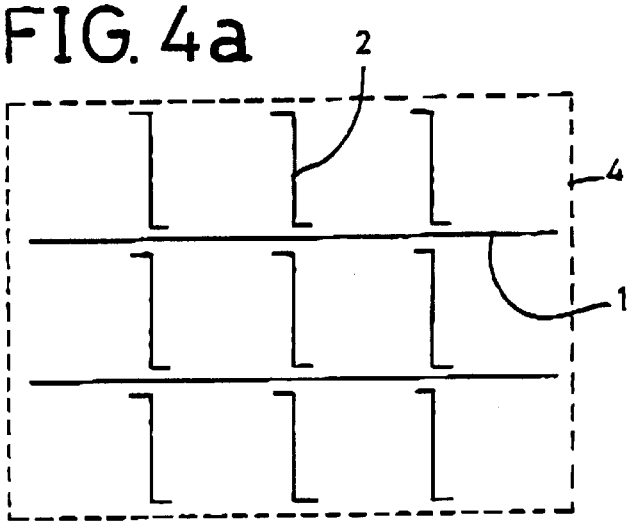
FIG. 4b
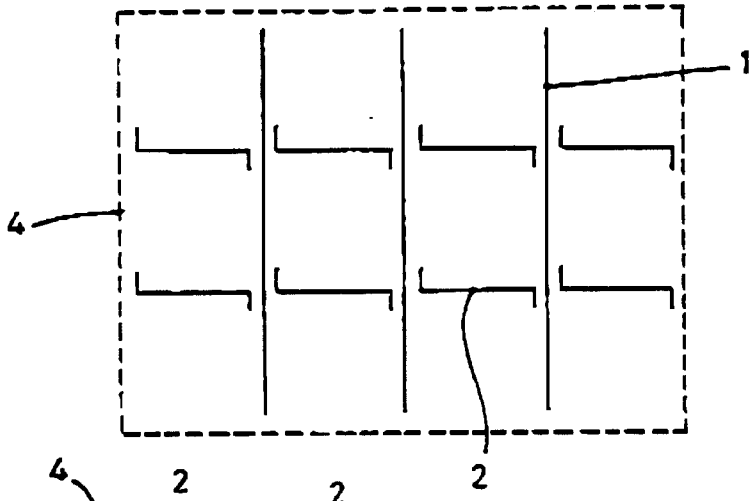
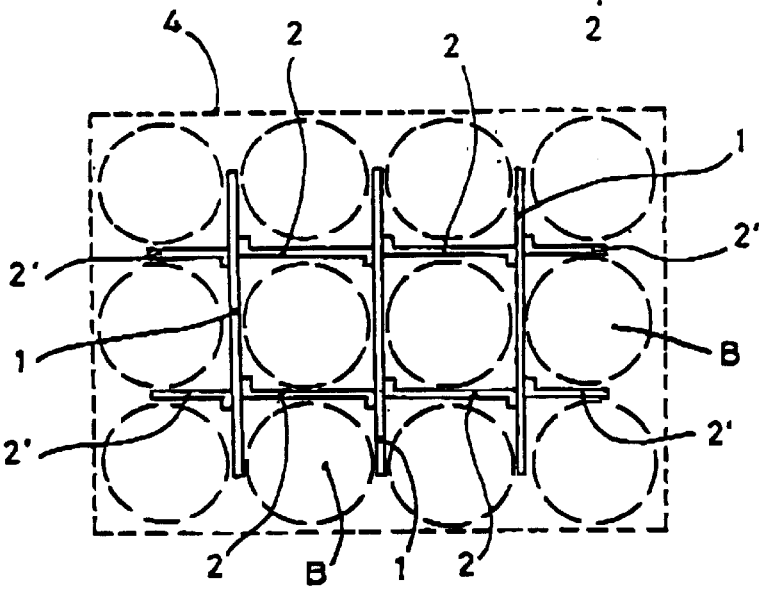
FIG. 5

DIVIDER FOR CARDBOARD BOXES

The present invention relates to a divider for cardboard boxes, of the type formed by sheets which divide the inner space of the box into compartments, which can be produced in a continuous process and involves a considerable saving of materials with respect to other known dividers.

BACKGROUND OF THE INVENTION

Known in the art, for example in Spanish patent P9400980, are dividers for foldable cardboard boxes, which are manufactured in a continuous process by overlapping and gluing a number of strips of cardboard and then cutting a suitable length from the assembly; folded dividers are thus produced, which before insertion into the boxes or when the box is unfolded for use, unfold in their turn to define the compartments into which the products, such as bottles, are to be arranged.

These known dividers are practical because they can be manufactured by a continuous process and, if desired, stored together with their own folded box; however, due to the arrangement of the strips which form the divider, the use made of the materials of the divider is not optimum.

Other known dividers which can be manufactured in continuous process are made up of strips of cardboard folded in zig-zag shape and glued to each other only by a small portion at the corners of the compartments, as in the case of U.S. Pat. No. 3,011 672; this divider nevertheless calls for very precise fitting of the strips, and is too fragile, for it can become unglued easily.

GB-A-911 027 describes a cellular structure formed by folding along a score line a component constituted by two flat parallel strips having a plurality of dividing walls between them.

DE-A-1 931 611 describes a divider for cardboard boxes formed from elementary modules, each module comprising two parallel flat strips and a plurality of transverse dividing walls between them, each dividing wall having flaps glued to the flat strips. This document is considered the closest prior art to the present invention and constitutes the basis for the preamble of appended claim 1.

DESCRIPTION OF THE INVENTION

The main object of the present invention is to provide dividers for foldable cardboard boxes which can be manufactured in a continuous process and consume less materials than known dividers, without thereby detracting from the qualities of the divider.

In accordance with this object, the divider of the invention for cardboard boxes is as defined in claim 1.

This divider has all the advantages of the known dividers, in particular the possibility of being manufactured by a totally automated continuous process, while further permitting a considerable saving in materials without thereby being detrimental to its strength.

Advantageously, said flat strips and said dividing walls present projections and incuts of complementary shape; thereby, and due to continuous-process manufacturing of the divider, materials can be saved.

In the event of the divider being intended to be fitted folded into a foldable box and stored together therewith until the time of use, on two opposite sides there are dividing walls linked by one of the flaps to an intermediate flat strip, but with the other flap left free so that it can be glued to one wall of the box. The folded divider is inserted into a box and the free flaps glued to the walls of the box in such a way that when the box is unfolded for use the divider is also unfolded.

If, on the other hand, the divider is to be unfolded and inserted into a box which is already open, it is provided on two opposite sides with dividing walls which are linked by one of the flaps to an intermediate flat strip and by the other flap to a flat end strip, the latter remaining in contact with one wall of the box. The divider is unfolded with the help of the end strips and is inserted into the open box; the end strips also prevent the divider from folding again.

Advantageously, the flat end strips are of different material or thickness from the intermediate flat strips, since these strips do not have the function of protecting the products stored in the box.

In one embodiment, the dividing walls are glued to the flat strips slightly offset from each other, so that the divider fits the box well and all compartments are of the same size.

According to another aspect of the invention,

In this case the divider is not attached to the box, but rather the products themselves, such as bottles, keep it in its place. This divider is particularly suitable for use on machines of the "wrap around" type, in which the bottles are first placed in a suitable arrangement and the divider is then inserted between them, and the box is formed and closed around the assembly.

Some dividing walls present two flaps, one at each end, and are intended to be arranged between two adjacent strips, while other dividing walls have only one flap at one of their ends, and are intended to be arranged between one strip and the wall of the box.

Also preferably, the dividing walls which have only one flap are of lesser width than that of the dividing walls with two flaps.

Materials are thereby saved, since the dividing walls do not have to reach the wall of the box because the bottles themselves prevent the divider from moving; the dividing walls and the strips adjacent to the walls of the box need only reach to approximately half of the diameter of the bottles in order to prevent two bottles from coming into contact with each other.

BRIEF DESCRIPTION OF THE DRAWINGS

For a better understanding of all that has been set out, some drawings are attached which, schematically and solely by way of non-restrictive example, show a practical case of embodiment.

In said drawings:

FIGS. 4*a*, 4*b* are schematic drawings which show o possible arrangements for a twelve-compartment divider;

FIG. 5 is a plan view of a variant of embodiment the divider of the invention.

DESCRIPTION OF A PREFERRED EMBODIMENT

Figure 1:
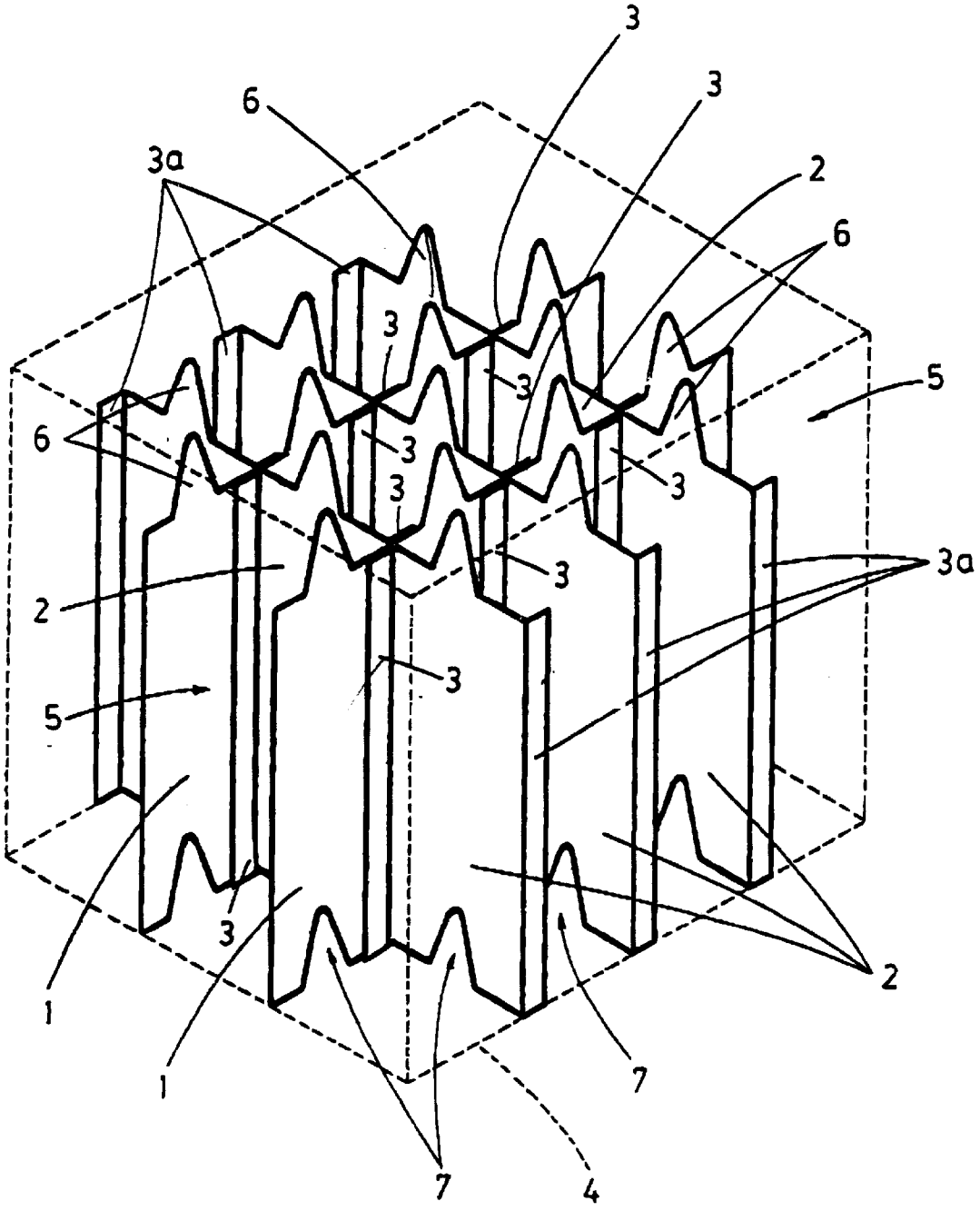
FIG. 1 is a perspective view of a divider in accordance with the present invention, totally unfolded in its use position.
Figure 2:
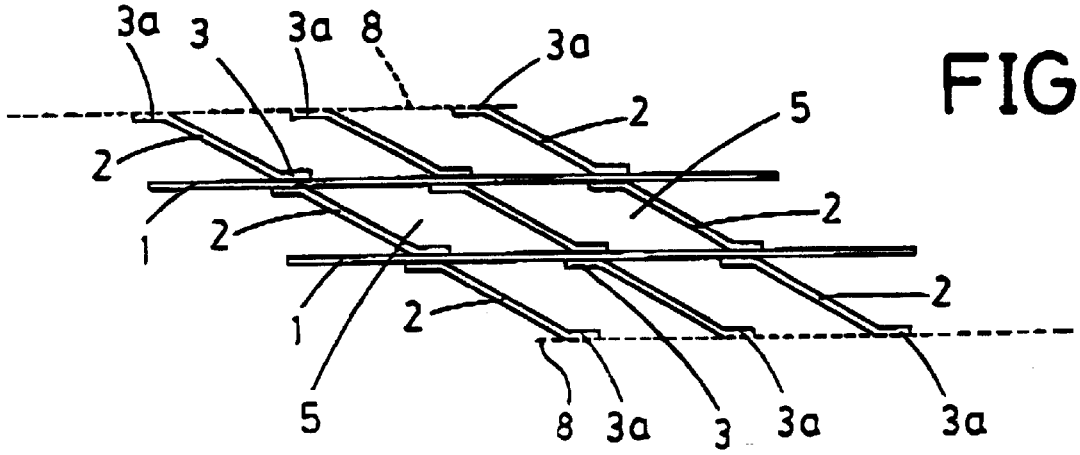
FIG. 2 is a plan view of the divider of FIG. 1, partially folded.

As shown in FIGS. 1 and 2, the divider, of the present invention comprises a number of flat strips 1 parallel to each other, two in the case shown, which will hereinafter be called longitudinal strips, solely in order to assign a geometric reference to the divider in order to facilitate description.

With the strips 1 are associated a plurality of transverse dividing walls 2, shorter than the strips 1 and also parallel to each other, which-have flaps 3, 3*a* on their ends for gluing, respectively, to the strips 1 and to the walls of the box 4.

In the example shown in FIG. 1 and a there are nine transverse dividing walls 2, which as can be seen will form a total of twelve compartments 5 with the longitudinal strips 1, once the divider is placed in a box (FIG. 1).

The length of the flat strips 1 is equal to a dimension of the box to which the divider will be attached, while the length of each dividing wall 2, without the flaps, defines one of the dimensions of each compartment 5; the other dimension of the compartment is defined by the distance between each two dividing walls.

The shown divider has essentially square compartments, though simply by altering the dimensions and position of the transverse dividing walls compartments of another shape could be formed.

The strips can be of any thickness, depending on the specific needs of each case.

The constructional layout described has several advantages: on the one hand, consumption of materials is minimum, since there are no-double walls, while at the same time the dividing walls 2 are solidly fixed to the strips 1 by the flaps. Another advantage is that manufacturing of the divider can be carried out automatically and by a continuous process.

Indeed, the divider of the invention is manufactured with a continuous process similar to that described in documents ES 9400980 and U.S. Pat. No. 3,011,672, which can be referred to for further details: it suffices to mention here that along general lines this process consists in supplying from a number of coils several webs of cardboard of different widths (one web for each flat strip, and one web for each dividing wall), overlapping them in suitable reciprocal positions and with application of an adhesive on the zones which will correspond to the flaps, pressing the assembly and finally cutting portions thereof transversally, each cut portion constituting a folded divider ready for insertion into a box.

Advantageously, prefolding or weakening lines are formed on the strips corresponding to the dividing walls 2, to facilitate subsequent unfolding of the divider.

In one embodiment of the invention, which permits an even greater saving of materials, the divider has a number of complementary projections 6 and incuts 7 (see FIG. 1): the pointed projections 6 lengthen the divider to a suitable height to prevent the upper parts of the products stored in the compartments 5 from knocking against each other, while at the same time a complete section of material is saved.

Furthermore, for example in boxes for bottles, the pointed shape sometimes prevents the labels of the bottles from bending or tearing as they are inserted in the box.

The complementary shape of the projections and incuts is due to the fact that, in production of the divider, two dividers are separated from each other with a single transverse cut which can be given the desired shape.

The projections can be of any height and the incuts of any depth, depending on the product to be stored in the box and the saving of materials desired. The more pronounced the projections and incuts the greater the saving of materials.

Where it is desired to achieve a maximum saving by making the cuts very pronounced, the cuts are made in positions offset from the centre of the side wall of each compartment 5, so that in spite of the depth of the cut the zone located at half-height, where the products (particularly bottles) are widest and need greatest protection, is never left open.

The described divider can be inserted, folded and with lines of adhesive applied to the flaps 3*a*, in a cardboard box 4, and stored with the box until the time of use; when the box is unfolded the divider also unfolds automatically.

The divider can nevertheless also be stored separately and inserted into a box once the box is unfolded, at the time of use; in this case, in order to facilitate unfolding of the divider and prevent it from folding again when it is left inside the box, two additional flat end strips 8.(shown in broken lines in FIG. 2) can be glued onto the flaps 3*a* of the dividing walls 2; in the previous case these flaps were glued directly to the box.

The end strips 8 do not have to exercise any protective function, for which reason they do not need the same features as the intermediate flat strips 1 or the dividing walls 2, so they can be manufactured from cardboard of lower quality or density, so as not to make the product more expensive, or they can be made thinner. Moreover, adding them does not pose any difficulties in the manufacturing procedure.

In principle, the dividing walls 2 are attached to the flat strips 1 in such a way as to be aligned with each other. In some cases, however, especially where the strips 1 and the dividing walls 2 are relatively thick, it happens that the divider remains aligned only towards one side of the box, while at the other side some free space is left, and the compartments 5 beside one the walls are then slightly smaller, and the compartments 5 beside the opposite wall are slightly larger; this is due to the effect of the thicknesses of the strips and dividing walls, which makes the dimension of the divider different when folded and when unfolded.

Figure 3:
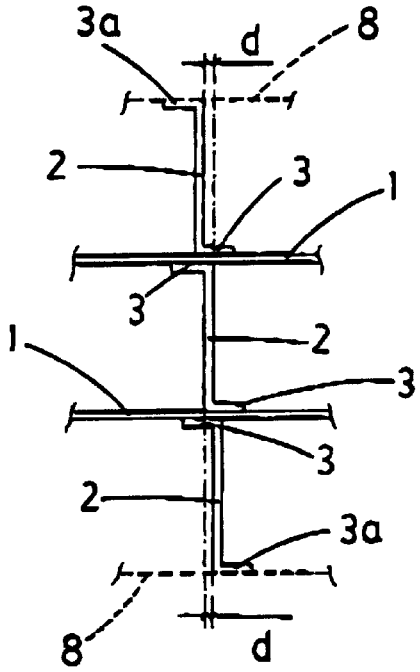
FIG. 3 is view of a detail of a particular embodiment of a divider in accordance with the invention.

In order to prevent this small difference, the dividing walls can be glued to the strips slightly offset with a distance d from one dividing wall to the next, as shown in FIG. 3.

FIGS. 4*a*, 4*b* show two different arrangements of the strips and the dividing walls for making a twelve-compartment divider; FIG. 4*a* corresponds to the embodiment shown in the previous figures, while FIG. 4*b* is an alternative which is also possible.

FIG. 5 shows a variant of embodiment, also included in the present invention. In this figure, the divider is shown inserted into a box 4 with a dozen bottles B.

In this variant, the dividing walls 2' left between one strip 1 and the wall of the box have only one flap 3, with which they adhere to the corresponding strip, and they are shorter than the dividing walls 2 fitted between two strips. The strips 1 are also shorter than in the embodiments described above, and do not reach the walls of the box 4.

The divider of FIG. 5 is not attached to the box: it is used with "wrap around" machines, in which the twelve bottles (or pertinent number) are first placed one beside the other according to the layout they will finally have in the box, and the divider is then fitted between them. Since the divider is inserted with the bottles already in position, it cannot fold or move, and it is not necessary to attach it to the box.

Although specific embodiments of the divider of the invention have been described and shown, it is clear that all details can be replaced by others which are technically equivalent without departing from the scope of protection defined by the attached claims.

In particular, it is clear that the divider could be manufactured with any number of compartments, depending on the requirements of each specific case, and that card-board or similar materials of any thickness and type could be used for the strips and dividing walls. A six-compartment divider, for example, could be manufactured with a single flat sheet and four dividing walls, two on either side of the sheet.

What is claimed is:

1. A divider for cardboard boxes, of the type formed by strips which divide the inner space of the box (4) into N rows of compartments (5) in the direction of the strips, with each row N having M compartments, said divider comprising:

a plurality of parallel flat strips (1) and a first plurality of dividing walls (2) and a second plurality of dividing walls (2') structured and arranged to transversely project from said flat strips (1);

each of said first and second plurality of dividing walls (2, 2') being parallel and equally spaced apart from each other, each of said first and second plurality of dividing walls (2, 2') being set between two of said adjacent flat strips (1) or between one of said flat strips (1) and an adjacent wall of said box (4), when a one of said first plurality of dividing walls (2) is set between said two adjacent flat strips (1), said one of said first plurality of dividing walls (2) has two flaps (3) foldably connected at two opposite ends thereof and glued to either side of said flat strips (1), and when a one of said first and second plurality of dividing walls (2, 2') is set between one of said flat strips (1) and said adjacent wall of said box (4) said one of said first and second plurality of dividing walls (2, 2') has either:

two flaps (3) foldably connected at two opposite ends thereof, wherein one of said flaps (3) is glued to said adjacent flat strip (1) and the other of said flaps (3) is glued to said adjacent wall of said box (4), or only one flap (3), glued to said adjacent flat strip (1) and said one of said second plurality of dividing walls (2') extending toward said adjacent wall of said box (4), wherein said divider is formed having N−1 number of said flat strips (1), all of which are substantially straight in all their length and have a length equal to or smaller than the length of one side of said box (4), and N·(M−1) number of said first and second plurality of dividing walls (2, 2'), said flat strips (1) being spaced apart from each other such that each strip (1) separates one row of compartments from an adjacent row and has one of said flaps (3) of at least one of said dividing wall (2, 2') glued to one side thereof and one of said flaps (3) of at least another of said first and second dividing walls (2, 2') glued to an opposite side thereof.

2. The divider according to claim 1, wherein said flat strips (1) and said first set of dividing walls (2) further comprise:

projections (6) and incuts (7) of complementary shape formed along a top and bottom edge thereof.

3. The divider according to claim 1, wherein said first set of dividing walls (2) of adjacent rows of said strips are glued to said flat strips (1) at a distance (d), slightly offset from each other.

4. The divider according to claim 1, wherein the length of parallel flat strip (1) is substantially equal to one of the dimensions of said box (4) and each of said first set of dividing walls (2) includes a first and a second flap **(3, 3*a*) disposed on either end of said wall (2)**.

5. The divider according to claim 4, intended to be fitted ad folded into a foldable box (4) and stored together therewith until the time of use, wherein:

said first flap (3) of said first set of dividing walls (2) being glued to a one of said plurality of parallel flat strips (1), and said second flap **(3*a*) of said first set of dividing walls (2) being glued to a wall of said box (4)**.

6. The divider according to claim 4, intended to be unfolded and inserted into a box (4) which is already open, wherein:

said first flap (3) of said first set of dividing walls (2) is glued to a one of said plurality of parallel flat strips (1), and said second flap **(3*a*) of said first set of dividing walls (2) is glued to a one of a plurality of flat end strips (8), whereby each of said plurality of flat end strips (8) interconnect said first set of dividing walls (2) and a wall of said box (4)**.

7. The divider according to claim 6, wherein each of said plurality of flat end strips (8) are made from at least one of a different material and a different thickness than said flat strips (1).

8. The divider according to claim 4, wherein said first set of dividing walls (2) are glued to said plurality of flat strips (1) and are offset a slight distance (d) from one another.

9. The divider according to claim 1, wherein:

said first set of dividing walls (2) comprises:

a first flap formed at a first end of each of said first set of dividing walls (2), and a second flap formed at a second end of each of said first set of dividing walls (2), wherein said first set of dividing walls (2) are arranged between a pair of adjacent parallel flat strips (1), and wherein said second set of dividing walls (2') comprises:

a single flap (3) formed at one end thereof such that each of said second set of dividing walls (2') are arranged between one of said plurality of parallel flat strips (1) and a wall of said box (4).

10. The divider according to claim 9, wherein said second set of dividing walls has a width (2') which is smaller than a width of said first set of dividing walls (2).

* * * * *